US005646337A

United States Patent [19]

Fonteyne

[11] Patent Number: 5,646,337

[45] Date of Patent: Jul. 8, 1997

[54] METHOD AND DEVICE FOR MEASURING PARAMETERS OF PLASTIC GROUND

[75] Inventor: Alfons Frans Fonteyne, Vosselaar, Belgium

[73] Assignee: Studiecentrum Voor Kernenergie, instelling van openbaar nut, Brussel, Belgium

[21] Appl. No.: 574,040

[22] Filed: Dec. 18, 1995

[30] Foreign Application Priority Data

Dec. 20, 1994 [BE] Belgium ..... 09401146

[51] Int. Cl.[6] ..... G01N 1/16

[52] U.S. Cl. ..... 73/61.63; 73/64.56; 73/863.23; 73/863.31

[58] Field of Search ..... 73/61.63, 61.64, 73/64.56, 863.23, 863.31, 864.34, 864.74

[56] References Cited

U.S. PATENT DOCUMENTS

| | | | |
|---|---|---|---|
| 2,111,982 | 3/1938 | Mason, Jr. | 73/863.31 X |
| 4,745,801 | 5/1988 | Luzier . | |
| 5,358,057 | 10/1994 | Peters et al. | 73/864.74 X |
| 5,465,628 | 11/1995 | Timmons | 73/864.74 X |
| 5,481,927 | 1/1996 | Hubbell et al. | 73/863.23 X |

FOREIGN PATENT DOCUMENTS

| | | |
|---|---|---|
| 0062022 | 10/1982 | European Pat. Off. . |
| 0641916 | 3/1995 | European Pat. Off. . |
| 261822 | 12/1985 | Japan . |

*Primary Examiner*—Hezron E. Williams
*Assistant Examiner*—Daniel S. Larkin
*Attorney, Agent, or Firm*—Bacon & Thomas

[57] ABSTRACT

A method for measuring parameters of plastic ground (2), includes forming a hole (3) in the ground (2) and placing a pipe (7) in this hole (3) to collect groundwater in various places. The pipe (7) is equipped with several closed chambers (8) which are closed off on the outside of the pipe (7) by filters (9), and through which conduits (10) extend. The conduits (10) are connected separately onto the chambers (8). Measurements are carried out after the plastic ground (2) has been pressed against the filters (9) through settling.

15 Claims, 2 Drawing Sheets

METHOD AND DEVICE FOR MEASURING PARAMETERS OF PLASTIC GROUND

BACKGROUND OF THE INVENTION

1. Field of the Invention

The present invention concerns a method for measuring parameters of plastic ground, according to which method a hole is made in the ground and a pipe is provided in this hole to collect groundwater in various places.

2. Discussin of the Prior Art

In a number of cases, it is required to measure the interstitial water in , for example, clay layers that are being considered to store waste in and to take samples of this water. This measuring must be done in various places in the ground.

Providing a separate borehole in every place to be measured and collecting water from these places via pipes which are provided in the boreholes is time-consuming and harms the environment to a large extent.

Hence, it has already been tried to measure the parameters of the ground in various places with one borehole and one pipe.

According to a known method, a borehole is drilled which is considerably larger than the pipe which is provided in it afterwards, whereby zones of the ground around the pipe are sealed by what are generally called packers, i.e. for example inflatable rings.

According to other known methods, fill material is provided around the pipe.

The application of packers or fill material is not only time consuming, but the methods do not allow for reliable measurements or restrict the possible measurements.

SUMMARY OF THE INVENTION

The invention aims to remedy these disadvantages and to provide a method for measuring parameters of plastic ground which allow for a large number of measurements in a simple manner in different places in the ground without the use of packers or fill material.

This aim is reached according to the invention in that a pipe is used which is provided with several closed chambers which are closed off on the outside of the pipe by means of filters, and in which conduits extend which are connected separately onto the chambers, and in that measurements are carried out after the plastic ground has been pressed against the filters by means of settling.

The invention also concerns a device which is particularly suitable for applying the above-mentioned method and which has a simple construction, but which allows for multiple and precise measurements.

Also, the invention concerns a device for measuring parameters of plastic ground, which contains a pipe, characterized in that the pipe has a number of closed chambers which are closed off on the outside of the pipe by means of filters, and conduits which are connected separately onto the chambers and extend through the pipe.

The conduits can be connected to a measuring laboratory which is situated, for example, beneath the ground.

According to a special embodiment of the invention, the chambers and thus also the filters are ring-shaped.

Other particularities and advantages of the invention will become clear from the following description of a method and device for measuring parameters of plastic ground according to the invention. This description is given as an example only and does not limit the invention in any way.

DETAILED DESCRIPTION OF THE PREFERRED EMBODIMENT

Figure 1:
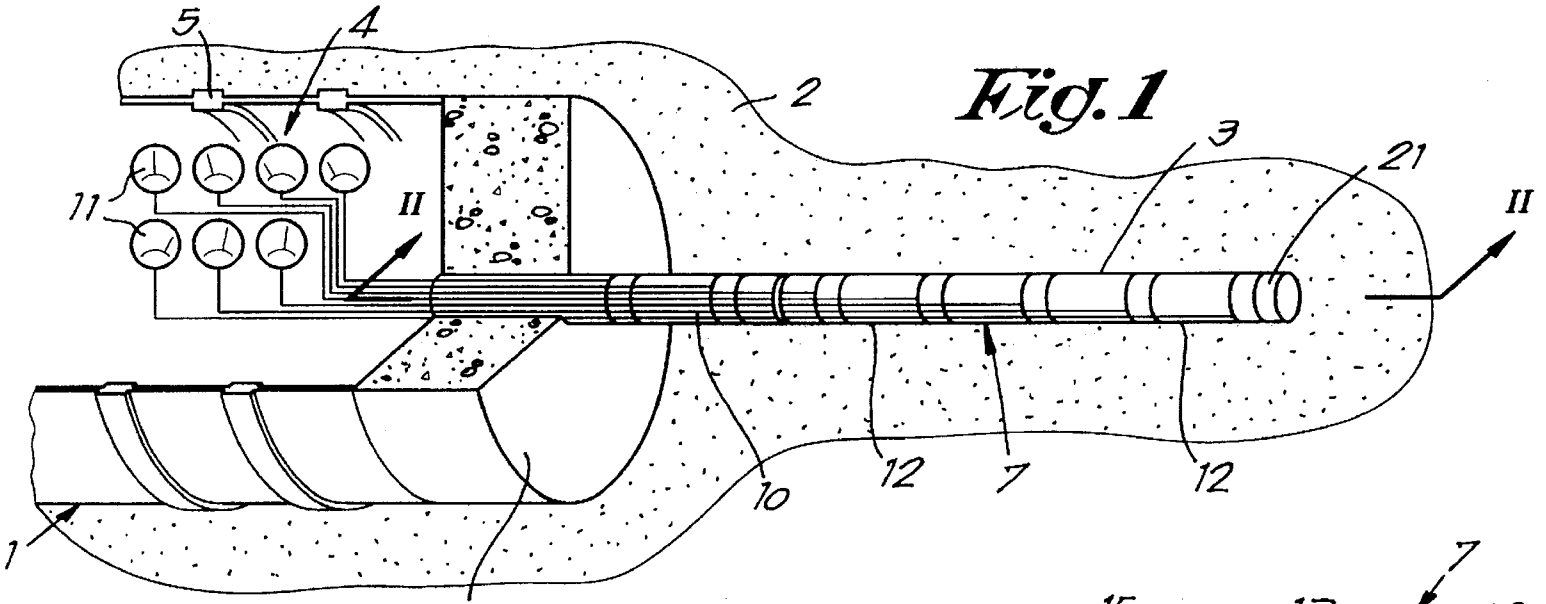
FIG. 1 shows a section of plastic ground with a borehole in which is provided a device according to the invention.
Figure 4:
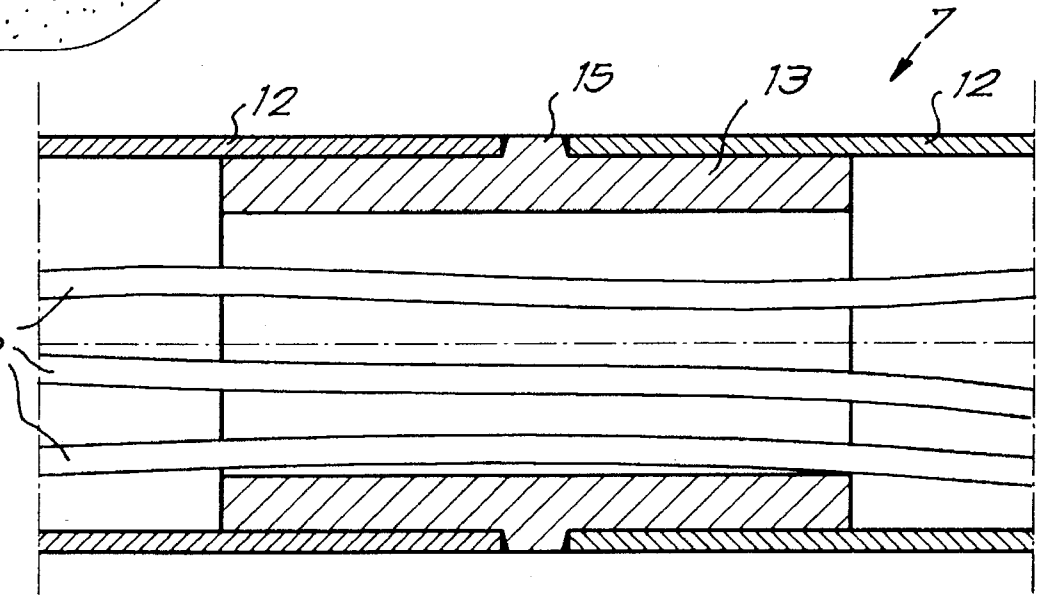
FIG. 4 shows the detail which is represented in FIG. 2 with F4 to a larger scale.
Figure 2:
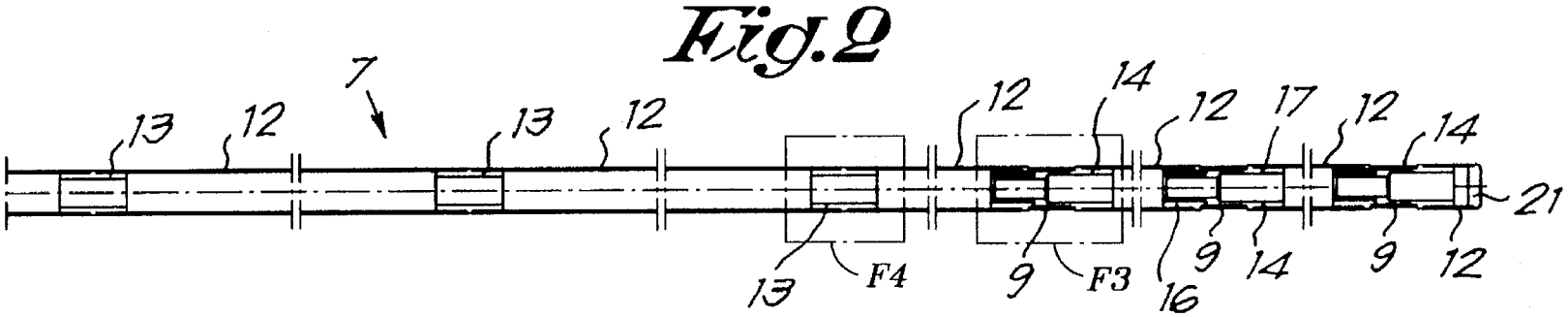
FIG. 2 shows a section according to line II—II in FIG. 1.
Figure 3:
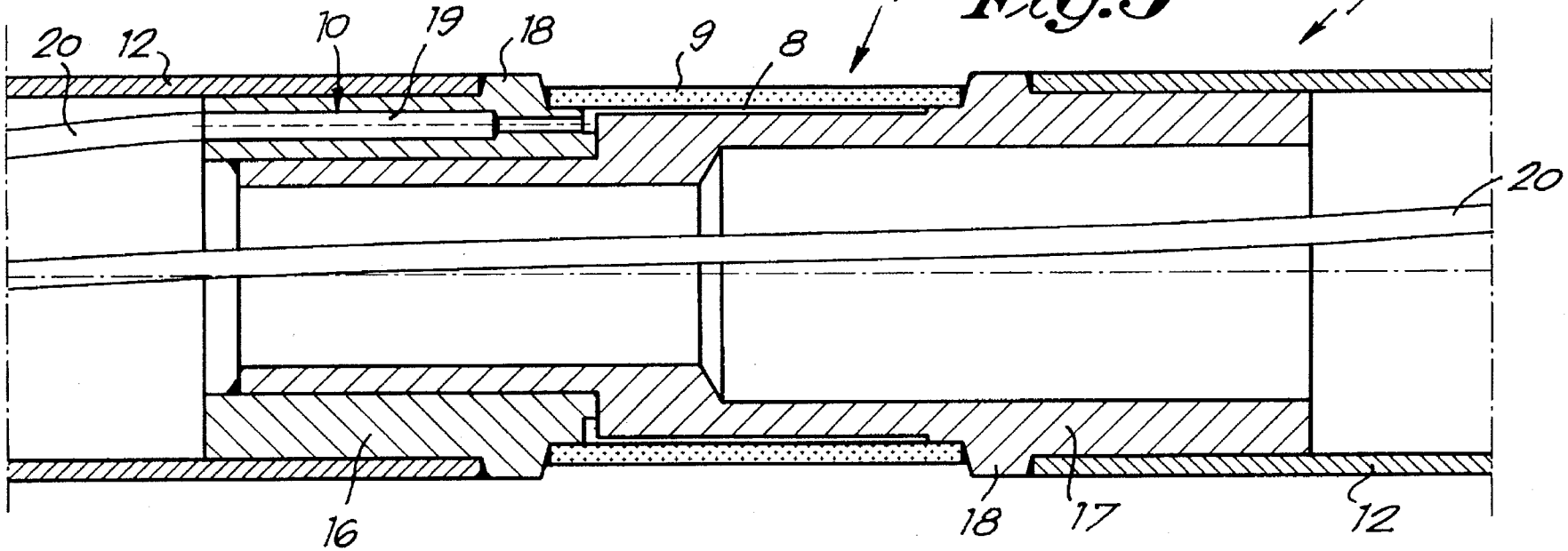
FIG. 3 shows the detail which is represented in FIG. 2 with F3 to a larger scale.

FIG. 1 shows a gallery 1 which was dug in plastic ground, namely clay ground 2, and into which opens a borehole 3.

At the end of the gallery 1 is formed an underground measuring laboratory 4. The gallery 1 is coated with a metal inner wall 5 and closed off on the side of the borehole 3 by means of a concrete wall 6.

The device for measuring the hydraulic pressure of the groundwater around the borehole 3 and for taking samples of this groundwater mainly includes a pipe 7 over which are spread a number of closed chambers 8 which are closed off on the outside by means of filters 9 and which are connected onto measuring equipment 11 via conduits 10 which include among other things manometers, and which is erected in the laboratory 4.

The pipe 7 is round and long, with a length of, for example, ten meters, and made of stainless steel. It includes of a number of pipe segments 12 with possibly varying lengths, which are connected to one another with connecting elements 13 or filter elements 14.

The connecting elements 13 each constitute of a short piece of pipe which is provided with a flange 15 on the outside and over which the pipe segments 12 to be connected are slid with one end. This end is welded to the flange 15.

The filter elements 14 include two pipe parts 16 and 17 and the ring-shaped filter 9. The pipe part 17 has a narrowed end which sticks in the pipe part 16 and is welded onto this part. Both pipe parts 16 and 17 have a flange 18 on their outside. A pipe segment 12 is slid over the pipe parts 16 and 17 up against the flange 18 and welded onto this pipe part.

The filter 9 is made of a rigid, porous material such as sintered stainless or ceramic material. It surrounds the pipe parts 16 and 17 between the two flanges 18 and is welded or glued onto these flanges. Opposite the filter 9, the pipe part 17 has a smaller diameter over a certain distance, so that an above-mentioned chamber 8 is formed between the filter 9 and the outside of the pipe parts 16 and 17.

In this chamber 8 opens a duct 19 which extends through the wall of the pipe part 16 and is connected onto a conduit 20 of stainless steel which is welded onto it and extends through the pipe 7 into the laboratory 4. The duct 19 and the conduit 20 together form the above-mentioned conduit 10 which connects the chamber 8 to the measuring equipment 11, erected in the laboratory 4, so that the hydraulic pressure in the chamber 8 can be measured. The conduit 20 can be removed from the measuring equipment 11, so that a sample can be taken via the conduit 20 of the water which filters through the filter 9 in the chamber 8.

The end of the pipe 7 is sealed by means of an end part 21.

Before the measuring, the borehole 3 is drilled in the ground 2 from the gallery 1.

The pipe 7 is provided in the borehole 3 immediately after the drilling, that has a diameter which is slightly bigger than the largest diameter of the pipe 7, i.e. the diameter of the ring-shaped filters 9. As the clay ground 2 settles, it will press rapidly, i.e. within a few hours, against the pipe 7 and thus also against the filters 9.

The flow rate which flows in the chambers 8 depends on the filters 9, so that these are selected as a function of the application. Thanks to these filters 9 and the direct contact of the ground 2 with these filters 9, precise measurements can be obtained in various places along the borehole 3, despite possible different hydraulic fields.

Since each of the chambers 8 is separately connected to the measuring equipment 11 and to, among other things, a manometer by means of conduit 10, the hydraulic pressure can be simultaneously measured in different places in the borehole 3. At the same time, other parameters can be measured such as the pressure gradient and the flow.

By disconnecting the pipes 20 from the measuring equipment 11, samples can be taken of the water in different places in the ground 2 via the conduits 10. These places are known since the distance between the chambers 8 and thus their location on the pipe 7 is known. On the basis of the samples, the conductance, the gas solubility, etc. can be measured.

Thanks to this device, the in-situ migration with sorbing and non-sorbing radionuclides, for example tritiated water, can be measured, in particular in clay layers that are being considered to store nuclear or toxic waste. Via conduit 10 and the chamber 8 with filter 9 connected onto it, such radionuclides can be injected in the ground 2. On the basis of measurements of the amount of nuclides in the water which is collected via other conduits 10 from other chambers 8, whose distance to the first-mentioned chamber 8 is precisely known, it is possible to check how and at what rate water migrates in the ground.

The invention is by no means limited to the above-described embodiment; on the contrary, within the scope of the patent application, many changes can be made to the described embodiment.

Thus, the pipe 7 can also be made of synthetic material instead of stainless steel. In this case, the welded joints can possibly be replaced by glued joints.

What is claimed is:

1. A method of measuring parameters of underground fluids comprising:

forming a hole in the ground;

inserting a pipe into the hole, said pipe having a plurality of spaced chambers that are closed off at respective outer radial portions of the pipe by filters, said chambers being separate and closed from one another;

providing a plurality of conduits each of which are separately connected to a respective one of said separate chambers;

allowing the ground to settle against said pipe; and measuring parameters related to flow of the fluids from said ground, through said filters, into said chambers and entering said conduits.

2. The method according to claim 1, wherein a measuring chamber is inserted into the ground to be connected to an end of the pipe.

3. The method according to claim 1, wherein said ground parameters are simultaneously measured through each of said chambers at different locations in said hole below the surface of the ground.

4. The method according to claim 1, wherein said parameters include among others hydraulic pressure, pressure gradients, conductance, gas solubility, radionuclides sorbing properties, and migration rates.

5. A device for measuring parameters of underground fluids comprising:

a pipe adapted to be placed within a hole formed in the ground, said pipe including a plurality of distinct chambers;

a plurality of filter elements, each having a filter, each of said filters being positioned at an outer radial portion of a respective one of said chambers of said pipe such that each of said filters closes a respective one of said chambers; and a plurality of conduits extending within said pipe with each conduit being separately connected to respective ones of said chambers wherein, when the pipe is placed within a hole in the ground and the ground settles against said pipe, parameters can be measured from flow of underground fluids entering said conduits through said filters and chambers.

6. The device according to claim 5, wherein said chambers and said filters are ring-shaped.

7. The device according to claim 5, wherein said pipe comprises a plurality of interconnected, adjacent pipe segments; and wherein each of said plurality of filter elements are connected to predetermined ones of said pipe segments, each of said filter elements including a respective said filter, at least predetermined ones of said chambers being each formed, within a respective said filter element, radially inwardly of said respective said filter.

8. The device according to claim 5, wherein said ground parameters can be simultaneously measured through each of said chambers.

9. The device according to claim 5, wherein said chambers are separated from one another along the pipe.

10. The device according to claim 5, wherein a measuring chamber is disposed within the ground at an upper end of said pipe, each of said plurality of conduits extending into said measuring chamber to measuring equipment.

11. The device according to claim 10, wherein a concrete wall is disposed within said ground below said measuring chamber to surround said pipe.

12. The method according to claim 5, wherein said parameters include among others hydraulic pressure, pressure gradients, conductance, gas solubility, radionuclides sorbing properties, and migration rates.

13. A device for measuring ground parameters comprising:

a pipe adapted to be placed within a hole formed in the ground, said pipe including a plurality of distinct chambers that open at respective outer radial portions of said pipe;

a plurality of filters, each of said filters being positioned at a respective one of said outer radial portions of said pipe such that each said filters closes a respective one of said chambers; and a plurality of conduits extending within said pipe and being separately connected to a respective said chamber wherein, when the pipe is placed within a hole in the ground and the ground settles upon said pipe, ground parameters can be measured from flow entering said conduits through said filters and chambers, wherein said pipe comprises a plurality of interconnected, adjacent pipe segments and said device further Comprises a plurality of filter elements interconnecting predetermined ones of said pipe segments, each of said filter elements including a respective said filter, at least predetermined ones of said chambers being each formed, within a respective said filter element, radially inwardly of a respective said filter;

wherein each said filter element comprises first and second interconnected pipe parts which are interconnected to respective said pipe segments, each said first and second pipe parts including a radially projecting flange, each of said filters extending between the projecting flanges of a respective said filter element, each of said chambers being formed between the filter and the first and second pipe parts of a respective said filter element.

14. The device according to claim 13, wherein a portion of each of said conduits constitutes a duct that extends within one of said first and second pipe parts of a respective said filter element and opens into a respective said chamber.

15. A device for measuring ground parameters comprising:

a pipe adapted to be placed within a hole formed in the ground, said pipe including a plurality of distinct chambers that open at respective outer radial portions of said pipe;

a plurality of filters, each of said filters being positioned at a respective one of said outer radial portions of said pipe such that each said filters closes a respective one of said chambers; and a plurality of conduits extending within said pipe and being separately connected to a respective said chamber wherein, when the pipe is placed within a hole in the ground and the ground settles upon said pipe, ground parameters can be measured from flow entering said conduits through said filters and chambers;

wherein said pipe comprises a plurality of interconnected, adjacent pipe segments and said device further comprises a plurality of filter elements interconnecting predetermined ones of said pipe segments, each of said filter elements including a respective said filter, at least predetermined ones of said chambers being each formed, within a respective said filter element, radially inwardly of a respective said filter; and further comprising connecting elements interconnecting adjacent said pipe segments, each of said connecting elements including first and second ends positioned within adjacent said pipe segments.

* * * * *